United States Patent [19]

Yamada

[11] 4,336,477

[45] Jun. 22, 1982

[54] SPARK PLUG

[75] Inventor: Shigeyasu Yamada, Nagoya, Japan

[73] Assignee: NGK Spark Plug Co., Ltd., Aichi, Japan

[21] Appl. No.: 45,816

[22] Filed: Jun. 5, 1979

[30] Foreign Application Priority Data

Jul. 28, 1978 [JP] Japan ..... 53/93044

[51] Int. Cl.[3] ..... H01T 13/20

[52] U.S. Cl. ..... 313/142

[58] Field of Search ..... 313/141, 142

[56] References Cited

U.S. PATENT DOCUMENTS

| | | | |
|---|---|---|---|
| 1,620,341 | 3/1927 | Gardner | 313/142 X |
| 2,120,492 | 6/1938 | Graf | 313/140 X |
| 3,970,885 | 7/1976 | Kasima | 313/141 |
| 4,109,633 | 8/1978 | Mitsudo et al. | 313/141 X |

*Primary Examiner*—Palmer C. Demeo

*Attorney, Agent, or Firm*—Sughrue, Mion, Zinn, Macpeak and Seas

[57] ABSTRACT

A spark plug where parts of a center electrode on both sides of an outer electrode are projected toward the outer electrode and a groove is formed in the outer electrode by cutting or grinding the central portion of said end surface. Discharge gaps are formed between on the outer projecting surfaces and the outer electrode.

7 Claims, 9 Drawing Figures

SPARK PLUG

BACKGROUND OF THE INVENTION

This invention relates to an improvement of ignitability of a spark plug.

In recently developed automotive engines, lean air/fuel mixture combustion is desired for purifying exhaust gases, and an spark advance tends to increase in order to reduce the fuel consumption, particularly during idle speed. For this reason, the idle speed does not spoil engine power. The present inventor has found that when the spark advance is increased, a spark discharge is generated during an engine compression stroke. Flame nuclei produced by the spark discharge are, as shown in FIG. 1, propagated from a position A to a position A' on a center electrode D side of a spark plug C in compliance with movement of a piston B. A quench operation of the center electrode is strongly applied to the flame, and this quench operation mainly causes a misfire during idle speed and a low speed rotation of the engine. A spark plug having a groove in a center electrode or an outer electrode in order to enhance ignitability has been heretofore provided. However, since such a spark plug having a groove is made irrespective of the above-noted fact, the enhancement of the ignitability is still deficient.

Within the prior art many such spark plug designs having various cuts, holes, etc. in the electrodes are known. Typical are the annular discharge portions shown in the inner and outer electrode surfaces of U.S. Pat. No. 4,015,160, the annular ring and channel arrangement of U.S. Pat. No. 4,023,058 and the V-type ground electrode with a channel shown in U.S. Pat. No. 2,226,415. Additional prior art is shown in U.S. Pat. No. 3,970,885 which includes, in addition to various groove embodiments a projection provided on the ground electrode (element 36, FIG. 25). As set forth in that patent, the projection is disposed in the spark discharge area confronting the tip surface of the center electrode. The flame nuclei produced by the spark are rapidly spread out over the projection to facilitate growth of flame nuclei and easy propagation of flame. The hallmark of all these prior art devices is the modification of the ground electrode to limit the area of the grounded surface. However, it has been found that many deficiencies remain, in actual use, so these spark plugs do not satisfactorily perform, especially in an idle speed engine condition.

SUMMARY OF THE INVENTION

An object of the present invention is to provide a spark plug which positively reduces a quench rate of flame nuclei and effectively prevents a generation of misfires during engine low speed condition, such as idle speed.

According to this invention, the spark plug is constructed so that flame nuclei are produced in a position where an influence of the flame retarding operation due to both the center electrode and the outer electrode is weak by projecting parts of the center electrode positioned on the both sides of the outer electrode toward the outer electrode or on both sides of outer electrode and in the direction of the outer electrode thereby forming a spark discharge gap between the parts and the outer electrode. In order to form projections in the central electrode, a groove opened to the outer electrode can be formed in the center electrode. The groove is enlarged. Alternatively, parts projected in the outer electrode direction and/or on both sides of the outer electrode can be weldingly connected to a part of the center electrode positioned on both sides of the outer electrode. An independent V- or U-shaped terminal metal can be weldingly connected to the tip end of the center electrode.

The present invention will be hereinafter described in detail referring to the accompanying drawings.

DESCRIPTION OF THE PREFERRED EMBODIMENTS

Figure 1:
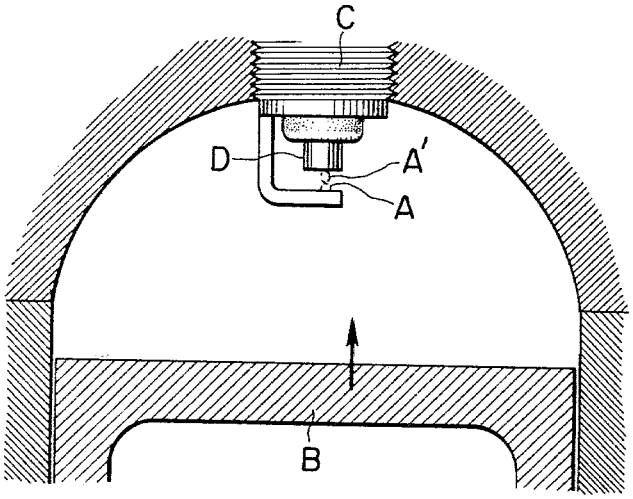
FIG. 1 shows a schematic view of an engine with a spark plug in position.
Figure 2:
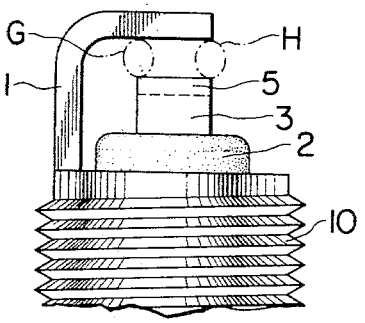
FIG. 2 shows a side view of a spark gap portion of the spark plug according to the present invention.

Referring now to FIG. 2 reference numeral 1 designates an L-shaped outer or ground electrode formed on a spark plug metal shell 10, cross section of which forms a closed region, in the specific embodiment shown, being in the form of a rectangle. An electric insulative material 2 extends from the metal shell 10, having a portion inside. A center electrode 3 is coaxially disposed into the electric insulative material 2 and extends outward as shown. Numerals 4 and 5 designate projections extending from the center electrode 3, formed by grinding an end surface of the center electrode and positioned on both sides 11 and 12 of the outer electrode 1.

Figure 3:
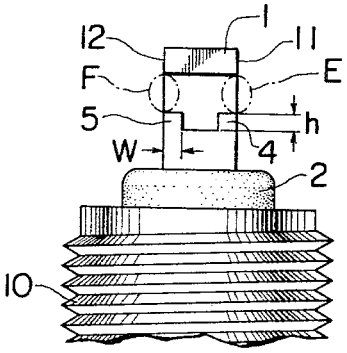
FIG. 3 shows a front view of the spark gap portion shown in FIG. 2.
Figure 4:
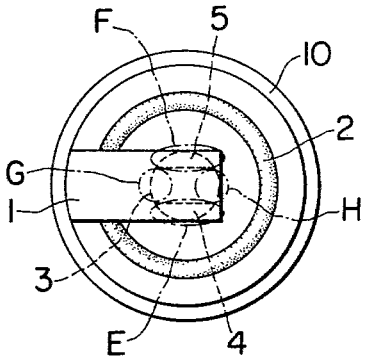
FIG. 4 shows a plan view of the spark gap portion shown in FIGS. 2 and 3.

In the above-described spark plug, spark discharges are generated in regions E and F (FIG. 3) defined between end surfaces of the projected parts 4 and 5 and the outer electrode. The spark discharges seldom occur in regions G and H (FIG. 2). The quench operation is seldom applied to the flame nuclei produced by the spark in the regions E and F which are far from the outer surfaces of the center electrode 3 and the outer electrode 1. The same effect is obtained when the flame nuclei produced by the spark are moved toward the center electrode.

Figure 5:
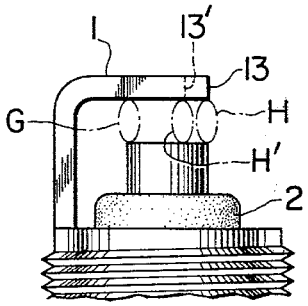
FIG. 5 PRIOR ART
FIG. 5 shows a side view of the spark gap portion where a deformation due to a lapse of service time appears.

In contrast, in the region G of the conventional spark plug as shown in FIG. 5, the flame nuclei tend to contact with the outer electrode, having a large contact surface to enhance the quench operation. Region H has a large contact surface with the center electrode if an end surface 13 of the outer electrode 1 is, as shown in FIG. 5, displaced to the central axis of the center electrode. That is, it is displaced to region H' defined by a surface 13' due to an assembling error and the lapse of service time. In this case, the flame nuclei are moved to the center electrode in compliance with the movement of the piston during the compression stroke as mentioned above, enhancing the flame-retarding effect. A height h of the projections 4 and 5 of the spark plug of this invention is at 0.1 to 2.5 mm and a maximum width W thereof is at 0.3 to 2.0 mm in view of the prevention of the misfire and the durability of the spark plug.

In the spark plug as shown in FIGS. 1 to 4, since the ignitability is enhanced and the projected portions are formed on an electrode which generally has electrically negative characteristics in use, the effect can be obtained where the discharge voltage is reduced. Further, the only requirement is to provide in the center portion, confronting the outer electrode of the center electrode, a groove formed by cutting or grinding in the final cutting process where the end surface of the center electrode is finished to determining the final dimensions thereof. Any additional complicated process such as welding, additional structure and the like is not required. Furthermore, according to the present invention, the outer and center electrodes have sufficient durabilities due to prevention of wearing-out of the electrodes and therefore, the spark plug of this invention has a high practical value.

Figure 6:
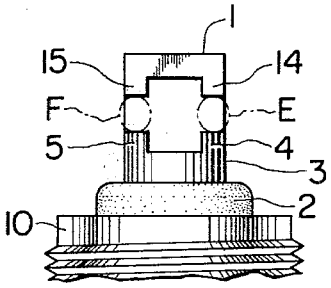
FIGS. 6 and 7 show other embodiments of spark gap portions according to the present invention.
Figure 7:
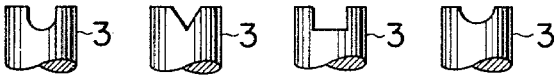

FIG. 6 shows another embodiment according to the present invention. Additionally, projections 14 and 15 or a groove may be provided with the outer electrode, corresponding to the projections 4 and 5 to further enhance the possibility of the spark discharge in the regions E and F. In providing the projections or the groove in the center and outer electrodes, configurations thereof such as U-shape, V-shape, rectangle and hemisphere can be used as shown in FIG. 7. The projections and grooves may be slantwise provided toward both sides of the outer electrode. However, irrespective of the configuration used, it is noted that two projections and a channel therebetween exist.

Figure 8:
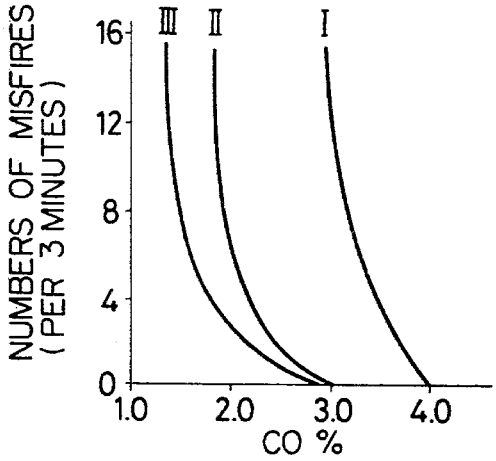
FIGS. 8 and 9 show graphs of numbers of misfires during idling.
Figure 9:
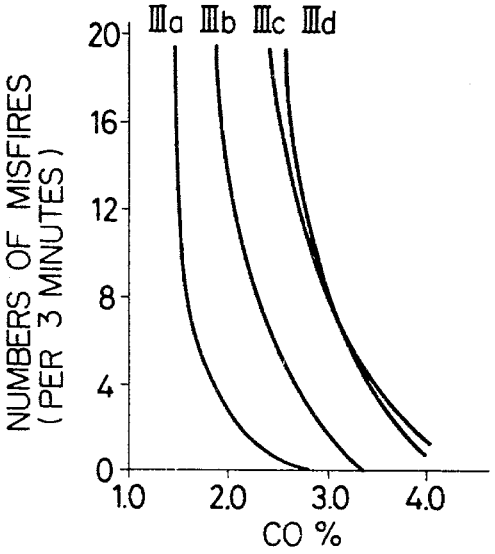

Experimental data on the operating characteristics of this spark plug will be hereinafter described. A four-cycle four-cylinder engine having a total piston displacement volume 2000 ml was used. FIG. 8 shows experimental results of a conventional spark plug (I) having a center electrode having an outer diameter of 2.4 mm $\phi$, a spark plug (II) having a rectangular groove having a depth of 0.5 mm and a width of 1.0 mm, formed in the outer electrode and a spark plug (III) having a V-shaped groove having a depth of 0.5 mm and a width of 1.0 mm to thereby forming projections in the center electrode in the direction of the outer electrode according to the present invention. The results show numbers of misfires per three minutes under the condition of the engine, BTDC 17° and idle speed 650 RPM, standardized as concentrations of CO contained in the exhaust gas, which correspond to the air/fuel ratios. It is obvious from these results that according to the present invention there is a significant reduction of misfires and the ignitability is excellent by use of a markedly lean air/fuel ratio during idle speed. FIG. 9 shows other experimental results of the spark plug (III). III(a) designates a spark plug wherein the direction of the groove is the same as that of the outer electrode. III(b), III(c) and III(d) designate spark plugs wherein the groove is intersected by the outer electrode at an angle of 30°, 60° and 90°, respectively. The numbers of the misfires were measured in the same manner. From the results, it is obvious that the plug III(a) has the smallest number of misfires where the groove is in the same direction of the outer electrode while the plug III(d) has the largest number of misfires where the groove is normal to the outer electrode. The effect of the present invention due to the fact that the projections are positioned in the center electrode toward both sides of the outer electrode is therefore substantiated.

As mentioned herein, the parts of the center electrode positioned facing the outer sides of the outer electrode are projected so that the spark discharge is selectively generated between the projections and the outer electrode. Therefore, the flame nuclei generated therebetween are out of the influence of the quench operation of the center and outer electrodes. Accordingly, misfire can be prevented during an engine low speed condition such as idle speed and the engine can be efficiently driven using a lean air/fuel mixture.

What is claimed is:

1. A spark plug comprising: a mount having a region of electric insulative material, a center electrode disposed in said insulative material and projecting outward, an outer electrode having a flat inner surface confronting an end surface of said center electrode and, means on said end surface of said center electrode defining projections extending toward said outer electrode, said means comprising a groove formed in said end surface of said center electrode to define raised portions positioned on the end surface of said center electrode.

2. The spark plug of claim 1 wherein the height of said projections from the end surface of the center electrode is in the range of 0.1 to 2.5 mm.

3. The spark plug of claim 1 wherein the width of said projections in a direction perpendicular to said groove is in the range of 0.3 to 2.0 mm.

4. The spark plug of claim 1 wherein said means defining projections comprises a geometric shaped center groove cutting symmetrically the end surface of said center electrode.

5. The spark plug of claim 4 wherein said groove is semicircular.

6. The spark plug of claim 4 wherein said groove is V-shaped.

7. The spark plug of claim 4 wherein said groove is rectangular.

* * * * *